US005309155A

United States Patent [19]

Hsien et al.

[11] Patent Number: 5,309,155

[45] Date of Patent: May 3, 1994

[54] CONTROL APPARATUS FOR NETWORK TRAFFIC LIGHT

[75] Inventors: Chien-Hsing Hsien; Eric Han; Jin-Chyuan Hung; Hwei-Shong Chun, all of Hsinchu, Taiwan

[73] Assignee: Industrial Technology Research Institute, Taiwan

[21] Appl. No.: 909,656

[22] Filed: Jul. 7, 1992

[51] Int. Cl.[5] ..... G08G 1/095

[52] U.S. Cl. ..... 340/907; 340/909; 340/915; 315/360

[58] Field of Search ..... 340/907, 909, 915; 315/360

[56] References Cited

U.S. PATENT DOCUMENTS

| | | | |
|---|---|---|---|
| 3,754,210 | 8/1973 | Preti | 340/917 |
| 3,816,796 | 6/1974 | Molloy et al. | 340/909 |
| 4,031,507 | 6/1977 | Johnson et al. | 340/916 |
| 4,257,029 | 3/1981 | Stevens | 340/915 |
| 4,827,258 | 5/1989 | Evans | 340/907 |
| 4,857,921 | 8/1989 | McBride et al. | 340/902 |

FOREIGN PATENT DOCUMENTS

| | | | |
|---|---|---|---|
| 0061963 | 10/1982 | European Pat. Off. | 340/908 |

*Primary Examiner*—John K. Peng
*Assistant Examiner*—Nina Tong
*Attorney, Agent, or Firm*—Michael D. Bednarek

[57] ABSTRACT

A control apparatus for a network traffic light is provided with a main control device, a lamp control device, and a pair of power transmission lines connected between the main control device and the lamp control device in a ring-shaped fashion to carry the control signals which control each lamp set at an intersection. In this way, the layout engineering is simplified, and thus its cost is reduced. The ring-shaped layout permits the network traffic light to sustain its operation even if some of its lines are broken during road works. Maintenance of the control apparatus is also easy and fast.

10 Claims, 4 Drawing Sheets

CONTROL APPARATUS FOR NETWORK TRAFFIC LIGHT

BACKGROUND OF THE INVENTION

The present invention relates generally to an improved traffic light control apparatus, and more particularly to a control apparatus for a network traffic light.

The conventional control manner of previous traffic lights or traffic control signals is characterized by a switching circuit within the control box which sends a plurality of light signals to corresponding lamps at an intersection via their respective power lines. Such an intersection traffic light requires many control power lines. Thus, it is high in cost, is not easy to install, and is difficult to maintain and repair.

FIG. 1, shows the above-described traffic light system which comprises a main control box 100, sixteen control lines 30, and four light devices 21, 22, 23, and 24, each connected to the main control box 100 via four respective control lines 30. Such a traffic light system has several drawbacks:

1. A plurality of control lines are needed. Thus, it is difficult to install, and the cost is relatively high.
2. If parts of the control lines are broken during road works, the operation of all light devices in the same system will be affected.
3. The main control box is so complicated that maintenance is difficult and time-consuming.

Therefore it is desirable that the prior traffic light system should be improved.

SUMMARY OF THE INVENTION

The primary object of the present invention is to provide a control apparatus for a network traffic light which has a simplified layout for easy installation and can sustain operation even if a portion of its lines are broken during road works.

With the present invention, a control apparatus for a network traffic light comprises a main control device, a plurality of lamp control devices each adapted to be connected with a plurality of lamps, and a pair of power transmission lines connected between the lamp control devices and the main control device to permit communication between them.

The main control device includes:

first single-chip microprocessor capable of making control decisions, and encoding/decoding the communication signal;

first power line carrier communication circuit coupled with the first microprocessor and the power transmission lines for receiving output communication signals from the first microprocessor and then loading it onto the power transmission lines; and for unloading input communication signals from the power transmission lines and then inputting it into the first microprocessor;

a display device and key-in circuit coupled to the first microprocessor for displaying the operation state of the network traffic light and for inputting a sit signal keyed in by a user into the microprocessor; and a power line filter coupled to the power transmission lines to avoid power line harmonic interference.

Each lamp control device includes:

second single-chip microprocessor capable of controlling the ON/OFF states of the lamps, and encoding/decoding the communication signal;

second power line carrier communication circuit coupled between the second microprocessor and the power transmission lines for receiving output communication signals from the second microprocessor and then loading them onto the power transmission lines and for unloading the input communication signal from the power transmission lines and then inputting it into the second microprocessor;

a plurality of solid-state relays coupled between the second microprocessor and the lamps respectively actuated by the second microprocessor to turn the lamps; on/off and a plurality of lamp-failure detecting circuits coupled between the second microprocessor and the lamps for detecting operation failure of the lamps.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
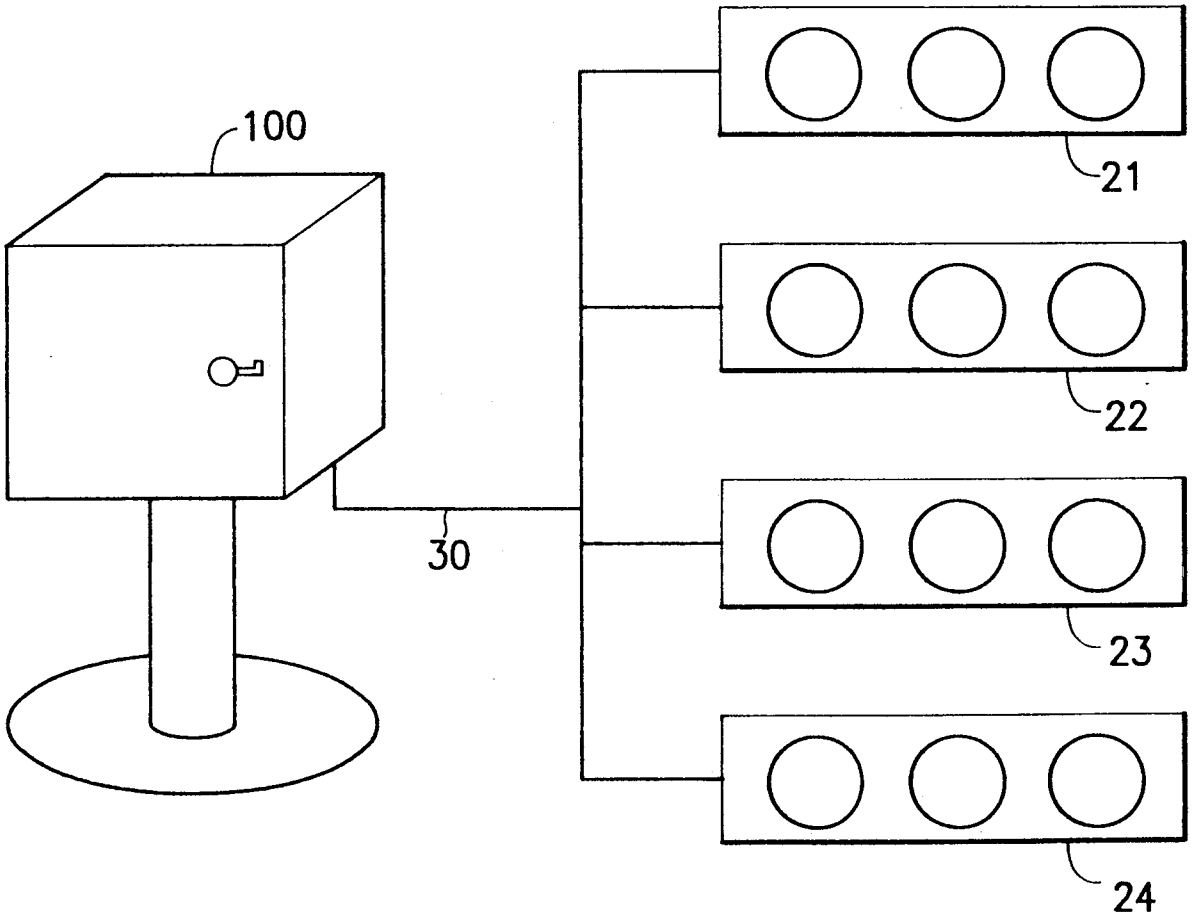
FIG. 1 (PRIOR ART)
FIG. 1 is a schematic block diagram of a prior traffic light system.
Figure 2:
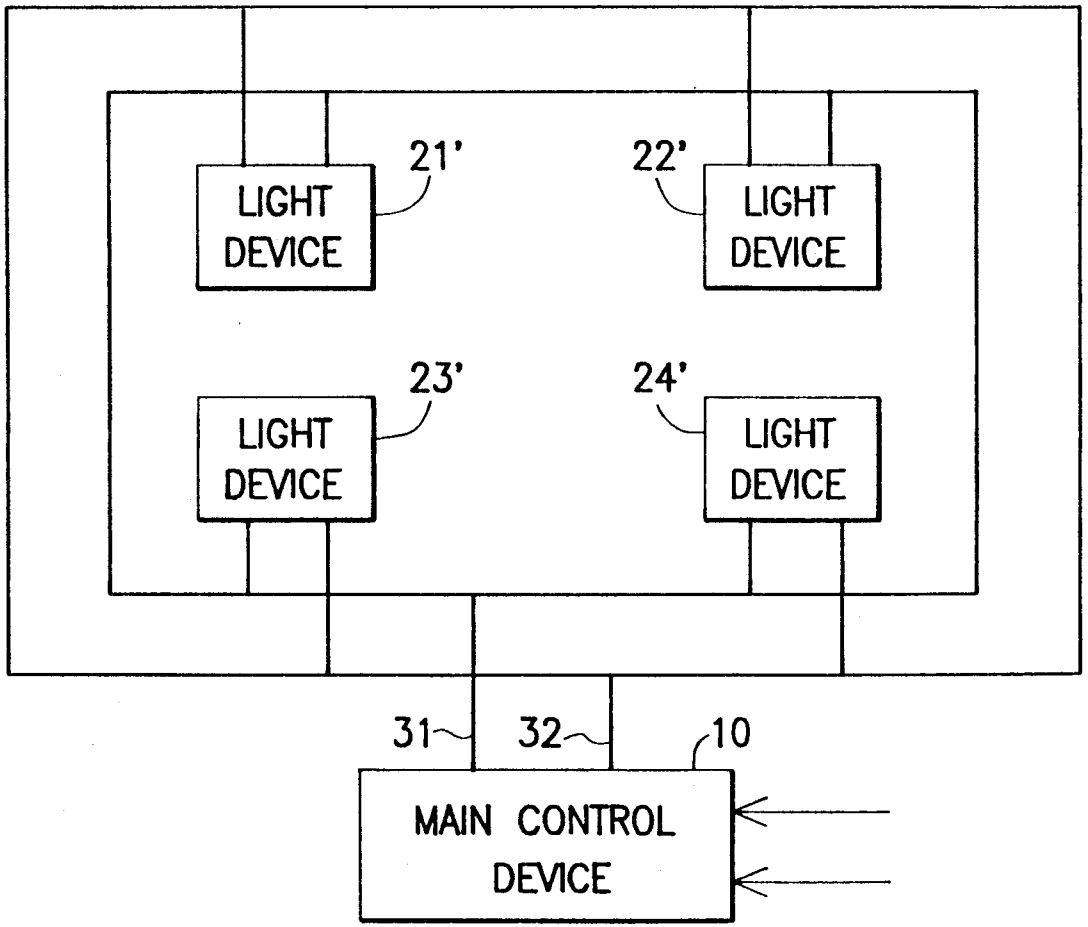
FIG. 2 is a schematic block diagram of a traffic light system in accordance with a preferred embodiment of the present invention.

FIG. 2 is a network traffic light system. Which comprises a main control device 10, a pair of ring-shaped power transmission lines 31 and 32 coupled to the main control device 10, and a plurality of, for example four, light devices 21', 22', 23', and 24', connected to the power transmission lines 31 and 32 in a parallel fashion. In this way, it is unnecessary to use separate control lines to connect the respective light devices to the main control device. The control of this network traffic light system utilizes power line carrier communication technology. More specifically, each light device 21', 22', 23', or 24', at the intersection is provided with a lamp control device 20 that connects with the main control device 10 via the power transmission lines 31 and 32 for the purpose of network communication control. As clearly seen in FIG. 2, the power transmission lines 31 and 32 are arranged as two ring-shaped loops.

Figure 3:
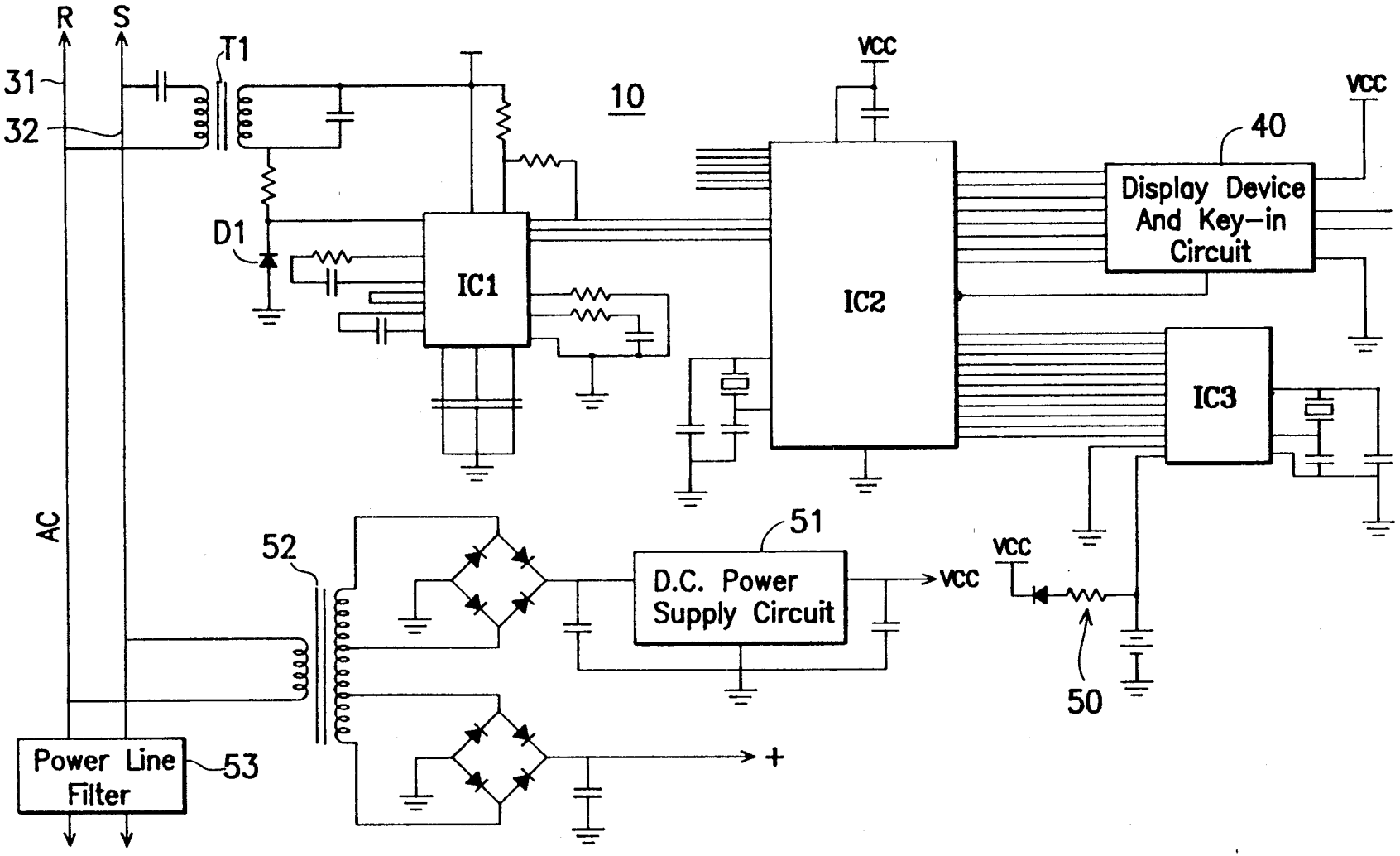
FIG. 3 is an electric circuit diagram of a main control device within the traffic light system of FIG. 2.
Figure 4:
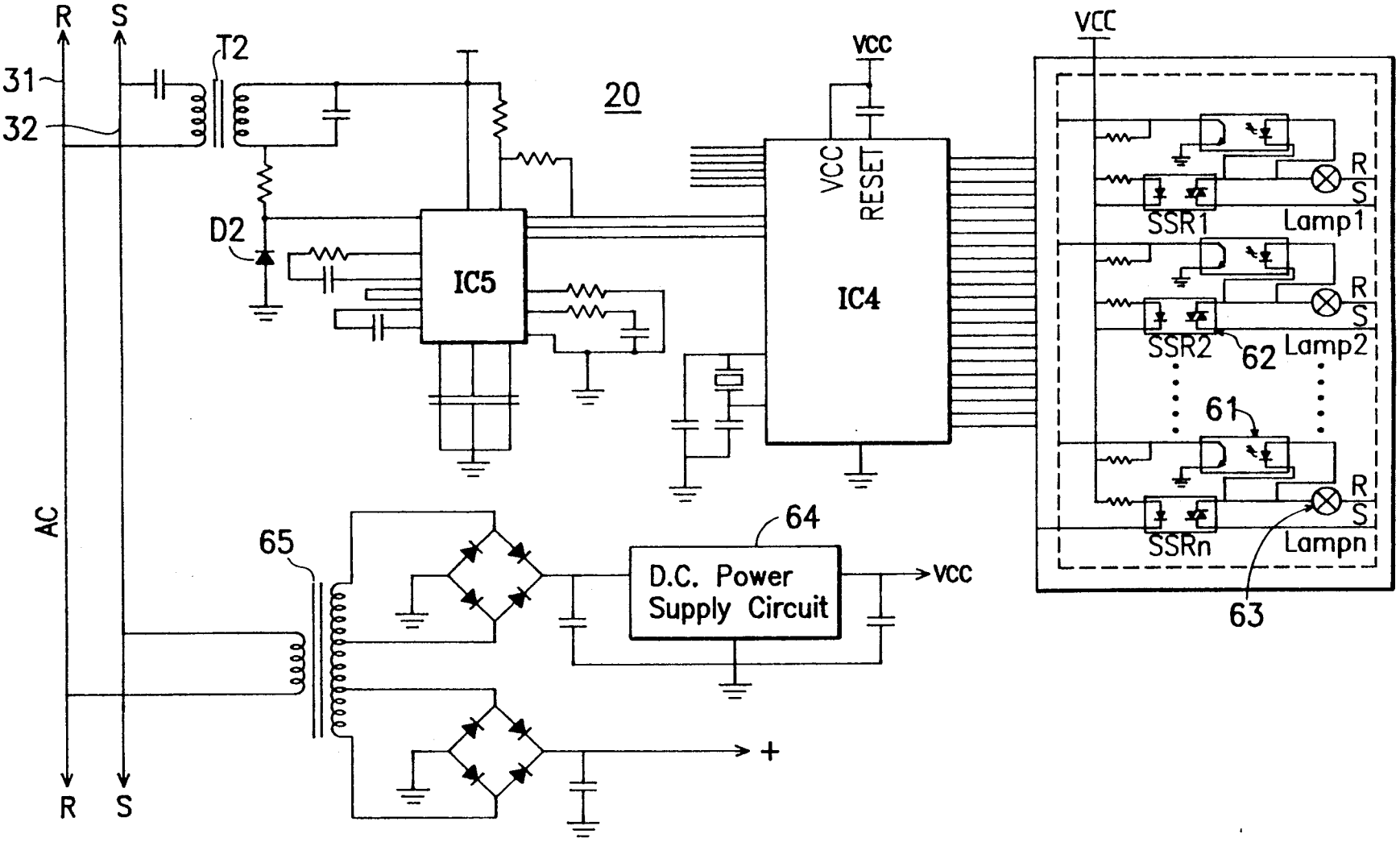
FIG. 4 is an electric circuit diagram of a lamp control device within the traffic light system of FIG. 2.

FIG. 3 shows the electric circuit of the main control device 10 in the network traffic light system of the present invention. FIG. 4 shows the electric circuit of the lamp control device 20 in each light device 21', 22', 23', or 24' of the network traffic light system.

As shown in FIG. 3, the main control device 10 contains a single-chip microprocessor IC2 which is the control core of the system. The microprocessor IC2 controls the ON/OFF states of all lamps in the light devices 21', 22', 23', and 24', and handles the failure conditions of the lamps. In addition, the microprocessor IC2 executes the encoding/decoding process for the network communication, and inputs/outputs the input- /output communication signal in a series communication manner.

The power line carrier communication circuit includes a high-frequency signal transformer T1 and a power line carrier modem circuit IC1 coupled to the microprocessor IC2. The modem circuit IC1 is utilized to modulate the output communication signal of the microprocessor IC2 into an output power line carrier signal, and to demodulate the input power line carrier signal on the power transmission lines 31 and 32 into the series input communication signal which is then inputted to the microprocessor IC2. The high-frequency signal transformer T1 is coupled between the modem circuit IC1 and the power transmission lines 31 and 32, and is utilized to load the output power line carrier signal onto the power transmission lines 31 and 32, and to unload the input power line carrier signal on the power transmission lines which is sent from the lamp control device 20.

A display device and key-in circuit 40 is coupled to the microprocessor IC2, and is utilized to display the operation states of the system and to input the set signals keyed in by a user.

A calendar clock circuit IC3 is coupled to the microprocessor IC2 to provide the timing base for the changing of light signals.

A clock spare chargeable battery device 50 is coupled to the calendar clock circuit IC3 to provide temporary power when commercial power is interrupted.

A D.C. power supply circuit 51 can supply two kinds of working voltages, for example +5 V and +30 V, to the appropriate circuits of the main control device 10.

A power source transformer 52 is utilized to transform a large A.C. voltage, for example the commercial power 110 V, into two smaller A.C. power sources, for example 6 V and 24 V.

A power line filter 53 is utilized to provide an isolating site, and consists of inductors and capacitors. The filter 53 is coupled to the power transmission lines 31 and 32 to filter external power line noise and harmonices, and to avoid leakage of the high frequency communication in the power line.

A diode D1, for example, a zener diode, is connected between the modem circuit IC1 and the high-frequency signal transformer T1 to prevent overly large signal inputs from damaging the inner circuits of the modem circuit IC1.

The main control device 10 is coupled to the power transmission lines 31 (or R) and 32 (or S) , and utilizes the power transmission lines R and S to transmit electrical power, control signals, and lamp failure signals. The power transmission lines R and S are connected to the lamp control device 20 described hereinafter via the power line filter 53.

Each light device 21', 22', 23', or 24' shown in FIG. 2 is provided with one lamp control device 20 shown in FIG. 4. Four lamp control devices 20 are connected together in a loop fashion. Each lamp control device 20 comprises a single-chip microprocessor IC4 which is the control core of the intersection light devices. The microprocessor IC4 is utilized to control the respective lamps 63 to turn on or off according to the light commands from the main control device 10, to detect whether the lamps 63 have failed or not, and to transmit any lamp failures back to the main control device 10. In addition, the microprocessor IC4 executes the encoding/decoding process for the network communication, and inputs/outputs the input/output communication signal in a series communication manner.

A power line carrier communication circuit includes a high-frequency signal transformer T2 and a power line modem circuit IC5. The high-frequency signal transformer T2 is coupled between the power line modem circuit IC5 and the power transmission line 31 and 32, and is utilized to load the output power line carrier signal onto the power transmission lines 31 and 32, and to unload the input power line carrier signal on the power transmission lines 31 and 32 that is sent from the main control device 10. The modem circuit IC5 is coupled to the microprocessor IC4, and is utilized to modulate the output communication signal of the microprocessor IC4 into the output power line carrier signal, and to demodulate the input power line carrier signal from the transformer T2 into the series communication signal which is then inputted to the microprocessor IC4.

A plurality of lamps 63 are utilized to display the traffic signals.

A plurality of lamp failure detection circuits 61 are coupled between the microprocessor IC4 and the lamps 63. The number of the detection circuits depends upon the number of the lamps 63. Each detection circuit 61 consists of a light emitting diode 66, a photocoupling transistor 67 and a low-resistance resistor 68, and is utilized to detect whether a lamp 63 is usable or burned out. If a lamp 63 is normal, the photocoupling transistor is turned on because there is a current flowing through the resistor; otherwise the transistor is turned off, and a signal is sent back to the microprocessor IC4 to determine whether the lamp 63 has failed.

A plurality of solid-state relays (SSR) 62 are coupled to the lamps 63 to turn them on or off. The solid-state relays 62 are also coupled to and controlled by the microprocessor IC4. The number of solid-state relays depends upon the number of lamps 63.

A D.C. power supply circuit 64 is provided, and its function is similar to the D.C. power supply circuit 51 of the main control device 10.

A power source transformer 65 is provided, and its function is similar to the power source transformer 52 of the main control device 10.

A diode D2, for example a zener diode, is connected between the modem circuit IC5 and the high-frequency signal transformer T2, and its function is similar to the diode D1 of the main control device 10.

In conclusion, the control apparatus of the present invention has several advantages, for example:

1. It uses a ring-shaped layout so that the network traffic light system can sustain its operation even if some of its lines are broken during road works.
2. The layout is simplified so that installation is easy and costs are reduced.
3. The main control device is simplified so that maintenance is easy and fast.
4. Each intersection lamp control device can automatically detect whether the lamps have failed, and can notify the main control device to send a repairman.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A control apparatus for a network traffic light comprising: a main control device, a plurality of lamp control devices each adapted to be connected with a plurality of lamps having on and off states, and a pair of power transmission lines connected between said lamp control devices and said main control device to permit them to communicate with each other;

said main control device includes:

first single-chip microprocessor capable of making control decisions for controlling the on and off states of said lamps and encoding and decoding a communication signal;

first power line carrier communication circuit coupled between said first microprocessor and said power transmission lines for receiving an output communication signal from said first microprocessor and then loading it onto said power transmission lines; and for unloading an input communication signal from said power transmission lines and then inputting it into said first microprocessor;

a display device and key-in circuit coupled to said first microprocessor for displaying the operation states of said network traffic light and for inputting a set signal keyed in by a user into said microprocessor; and a power line filter coupled to said power transmission lines to avoid power line harmonic interference; and each lamp control device including:

second single-chip microprocessor capable of controlling the on and off states of said lamps, and encoding and decoding a communication signal;

second power line carrier communication circuit coupled between said second microprocessor and said power transmission lines for receiving an output communication signal from said second microprocessor and then loading it onto said power transmission lines; and for unloading an input communication signal from said power transmission lines and then inputting it into said second microprocessor;

a plurality of solid-state relays coupled between said second microprocessor and said lamps respectively, and being actuated by said second microprocessor to turn on/off said lamps; and a plurality of lamp fail detecting circuits coupled between said second microprocessor and said lamps respectively for detecting fail conditions of said lamps.

2. The control apparatus as claimed in claim 1, wherein said pair of power transmission lines are arranged as two ring-shaped loops, and wherein each of said lamp control devices is connected to said power transmission lines in parallel.

3. The control apparatus as claimed in claim 1, wherein each of said first and second power line carrier communication circuits includes a high-frequency signal transformer coupled to said power transmission lines and a power line carrier modem circuit coupled to said transformer, said transformer capable of loading the output communication signal onto said power transmission lines in a power line carrier modulation manner, and unloading the input communication signal from said power transmission lines to said modem circuit.

4. The control apparatus as claimed in claim 1, wherein each of said lamp fail detecting circuits includes a photocoupling transistor and a low-resistance resistor connected in parallel with said transistor.

5. The control apparatus as claimed in claim 3, wherein said main control device and each of said lamp control devices further include a diode coupled between said high-frequency signal transformer and said power line carrier modem circuit.

6. The control apparatus as claimed in claim 5, wherein said diode is a zener diode.

7. The control apparatus as claimed in claim 1, wherein said main control device and each of said lamp control devices include a D.C. power supply circuit for supplying power to circuits therein.

8. The control apparatus as claimed in claim 1, wherein said main control device and each of said lamp control devices include a power source transformer for transforming the A.C. commercial power into two smaller A.C. power sources.

9. The control apparatus as claimed in claim 1, wherein said main control device includes a calendar clock circuit coupled to said first microprocessor for providing a timing base.

10. The control apparatus as claimed in claim 9, wherein said main control device includes a chargeable battery device coupled to said calendar clock circuit to provide a temporary power when the commercial power is interrupted.

* * * * *